US010428780B2

(12) United States Patent
Eves

(10) Patent No.: US 10,428,780 B2
(45) **Date of Patent: *Oct. 1, 2019**

(54) FUEL INJECTOR MOUNTING SYSTEM FOR MOUNTING AN INJECTOR TO AN ENGINE CYLINDER LINER

(71) Applicant: Fairbanks Morse, LLC, Charlotte, NC (US)

(72) Inventor: Joseph C. Eves, Beloit, WI (US)

(73) Assignee: FAIRBANKS MORSE, LLC, Charlotte, NC (US)

( * ) Notice: Subject to any disclaimer, the term of this patent is extended or adjusted under 35 U.S.C. 154(b) by 142 days.

This patent is subject to a terminal disclaimer.

(21) Appl. No.: 15/845,437

(22) Filed: Dec. 18, 2017

(65) Prior Publication Data

US 2018/0106227 A1 Apr. 19, 2018

Related U.S. Application Data

(63) Continuation of application No. 15/151,244, filed on May 10, 2016, now Pat. No. 9,863,384.

(51) Int. Cl.

| | |
|---|---|
| ***F02M 61/14*** | (2006.01) |
| ***F02F 1/00*** | (2006.01) |
| *F02M 21/02* | (2006.01) |

(52) U.S. Cl.

CPC ..... *F02M 61/14* (2013.01); *F02F 1/004* (2013.01); *F02M 21/0275* (2013.01); *F02M 21/0281* (2013.01); *F02M 2200/85* (2013.01); *F02M 2200/851* (2013.01); *F02M 2200/855* (2013.01)

(58) Field of Classification Search

CPC .. F02M 21/0281; F02M 61/14; F02M 61/145; F02M 2200/85; F02M 2200/855; F02M 2200/858

USPC ..... 123/470

See application file for complete search history.

(56) References Cited

U.S. PATENT DOCUMENTS

| | | | |
|---|---|---|---|
| 3,247,833 | A | 4/1966 | Beddoes et al. |
| 3,960,119 | A | 6/1976 | Dimitracopoulos |
| 3,993,030 | A | 11/1976 | Jaulmes et al. |
| 4,860,710 | A | 8/1989 | Hafner et al. |
| 5,605,127 | A | 2/1997 | Yoshihara |

(Continued)

OTHER PUBLICATIONS

PCT Application No. PCT/US17/30849, International Search Report and Written Opinion, dated Aug. 1, 2017, 10 pages.

*Primary Examiner* — Erick R Solis
(74) *Attorney, Agent, or Firm* — Perkins Coie LLP

(57) ABSTRACT

Technology is provided for a fuel injector mounting system for mounting an injector to an engine cylinder liner. The system includes an injector adapter having an adapter body including a first end portion threaded for engagement with a cylinder liner and an injector port formed in the adapter body opposite the first end portion. The injector port includes a plurality of concentric bores configured to receive the proximal end portion of an injector. A flange extends transversely from the adapter body and a collar engages a portion of the injector and connects to the flange to retain the injector in the adapter. A transverse passageway extends through a sidewall of the adapter body and intersects the injector port and an annular fitting is disposed on the injector adapter for fluid communication with the transverse passageway. An injector support bracket attaches a distal end portion of the injector to the engine.

20 Claims, 7 Drawing Sheets

(56) References Cited

U.S. PATENT DOCUMENTS

| | | | | |
|---|---|---|---|---|
| 5,713,323 | A | 2/1998 | Walsh et al. | |
| 5,775,289 | A | 7/1998 | Yoshida | |
| 5,762,040 | A | 9/1998 | Taipale et al. | |
| 5,943,995 | A | 8/1999 | Niwa et al. | |
| 5,950,596 | A | 9/1999 | Kollmann | |
| 6,276,338 | B1 * | 8/2001 | Kato | F02B 23/104 123/41.31 |
| 6,295,969 | B1 | 10/2001 | Kato | |
| 8,245,697 | B2 * | 8/2012 | Biasci | F02M 55/005 123/456 |
| 8,640,673 | B2 * | 2/2014 | Male | F02M 55/005 123/469 |
| 9,181,851 | B1 | 11/2015 | Bandyopadhyay | |
| 2006/0102742 | A1 * | 5/2006 | Rigney | F02M 53/06 239/88 |
| 2008/0075403 | A1 | 3/2008 | Holt | |
| 2008/0216798 | A1 * | 9/2008 | Ghelardi | F02M 55/005 123/470 |
| 2015/0000640 | A1 | 1/2015 | Bandyopadhyay | |
| 2016/0252066 | A1 | 9/2016 | Johnson | |
| 2019/0032616 | A1 * | 1/2019 | Bernhardt | F02M 59/027 |
| 2019/0136855 | A1 * | 5/2019 | Heinemann | F04B 53/16 |

* cited by examiner

FUEL INJECTOR MOUNTING SYSTEM FOR MOUNTING AN INJECTOR TO AN ENGINE CYLINDER LINER

CROSS REFERENCE TO RELATED APPLICATION

This application is a continuation of U.S. patent application Ser. No. 15/151,244 filed on May 10, 2016, entitled "FUEL INJECTOR MOUNTING SYSTEM FOR MOUNTING AN INJECTOR TO AN ENGINE CYLINDER LINER," the disclosure of which is incorporated herein by references in its entirety.

TECHNICAL FIELD

This patent application is directed to fuel systems and, more specifically, to a fuel injector mounting system.

BACKGROUND

Typical fuel injection systems include a plurality of fuel injectors mounted to an associated engine. In some applications, the injectors are mounted such that they inject fuel into an air inlet port just behind an inlet valve. In other applications, the injectors are mounted to directly inject fuel into the combustion chamber. In any case, the injector must be retained in position and supplied with the appropriate fuel and control connections.

BRIEF DESCRIPTION OF THE DRAWINGS

Embodiments of the fuel injector mounting system introduced herein may be better understood by referring to the following Detailed Description in conjunction with the accompanying drawings, in which like reference numerals indicate identical or functionally similar elements.

Figure 1:
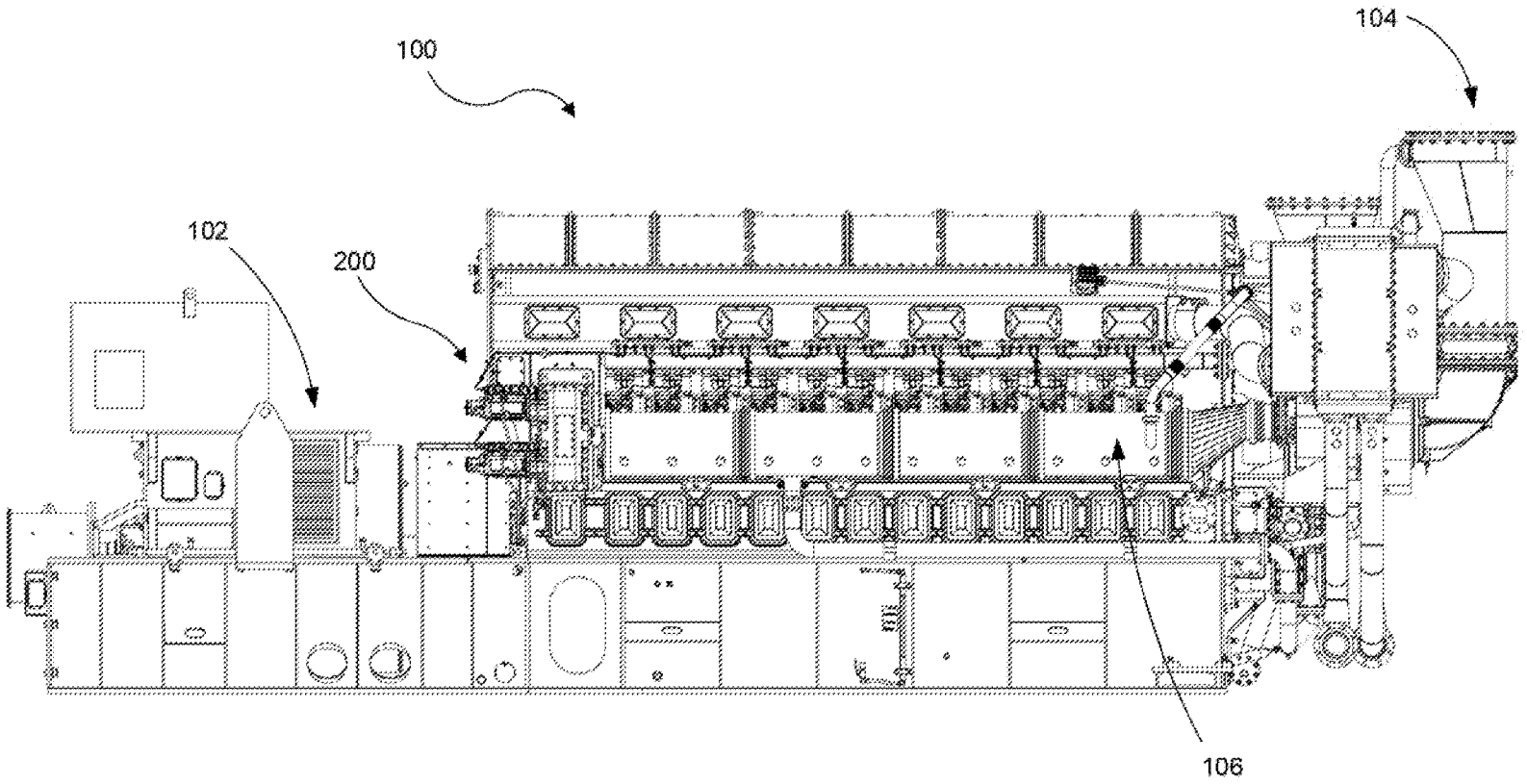
FIG. 1 is a side view in elevation of a multi-cylinder opposed piston engine according to a representative embodiment.

The headings provided herein are for convenience only and do not necessarily affect the scope or meaning of the claimed embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to limit the embodiments described. On the contrary, the embodiments are intended to cover all modifications, equivalents, and alternatives falling within the scope of the embodiments as defined by the appended claims.

DETAILED DESCRIPTION

Overview

A fuel injector mounting system for mounting an injector to an engine cylinder liner is disclosed. In an embodiment, the system includes an injector adapter having an adapter body including a first end portion threaded for engagement with a cylinder liner and an injector port formed in the adapter body opposite the first end portion. The injector port includes a plurality of concentric bores configured to receive the proximal end portion of an injector. A flange extends transversely from the adapter body and a collar engages a portion of the injector and connects to the flange to retain the injector in the adapter. In some embodiments, a transverse passageway extends through a sidewall of the adapter body and intersects the injector port and an annular fitting is disposed on the injector adapter for fluid communication with the transverse passageway. In some embodiments, an injector support bracket attaches a distal end portion of the injector to the engine.

General Description

Various examples of the device and systems introduced above will now be described in further detail. The following description provides specific details for a thorough understanding and enabling description of these examples. One skilled in the relevant art will understand, however, that the techniques discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

FIG. 1 illustrates a vertically oriented multi-cylinder opposed piston engine 100 according to a representative embodiment. In some embodiments, engine 100 is configured for electrical power generation and is connected to a generator 102. In other embodiments, the engine may directly or indirectly drive equipment or propulsion systems, such as for example and without limitation, pumps, drivetrains, wheels, propellers, etc. Engine 100 may be used in mobile as well as stationary applications. The engine 100 includes various systems, such as a fuel system 200, described more fully below, as well as an air intake system 104, and an exhaust system 106, for example.

Figure 2:
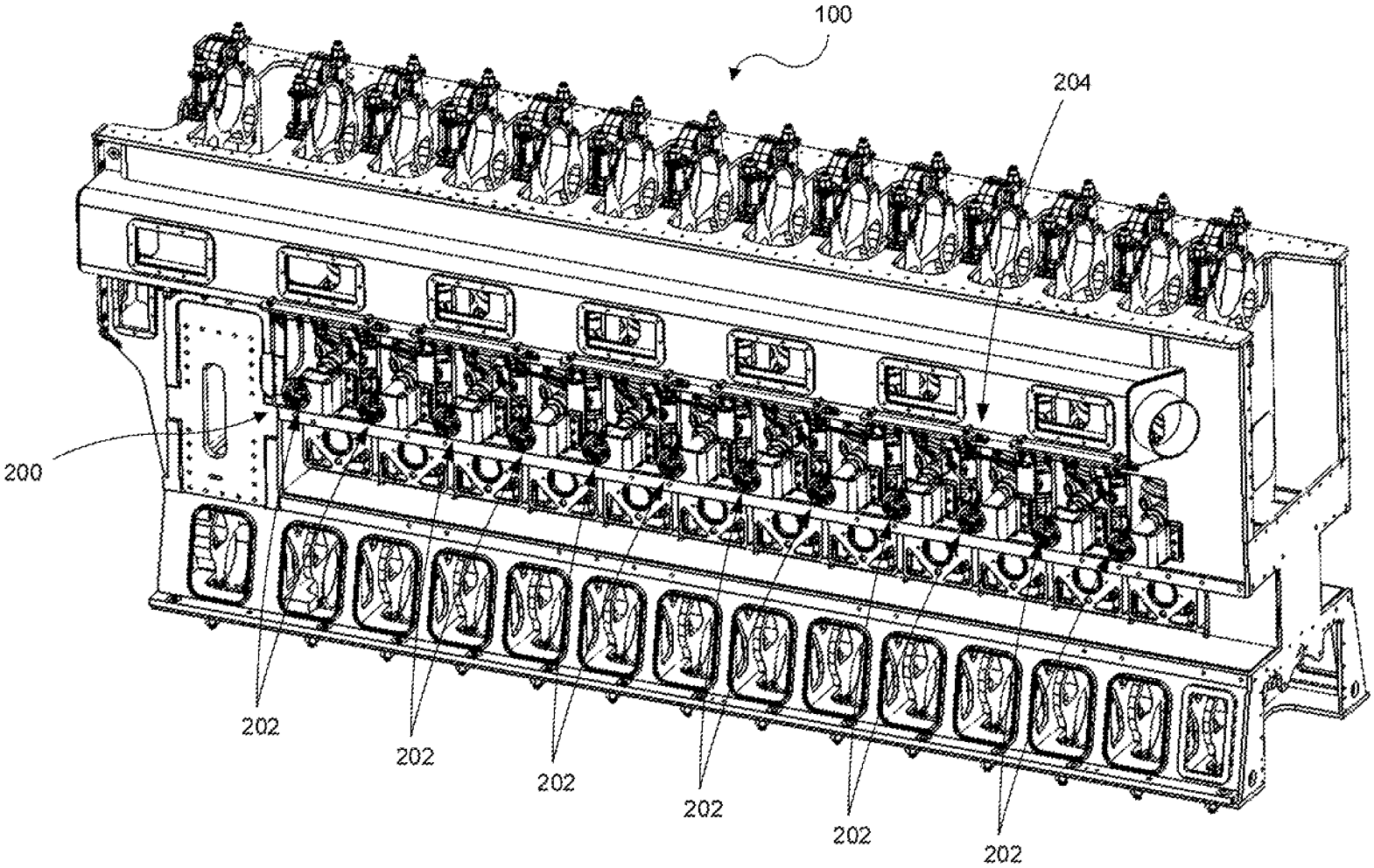
FIG. 2 is an isometric view of the engine shown in FIG. 1 with various components removed for clarity.
Figure 3:
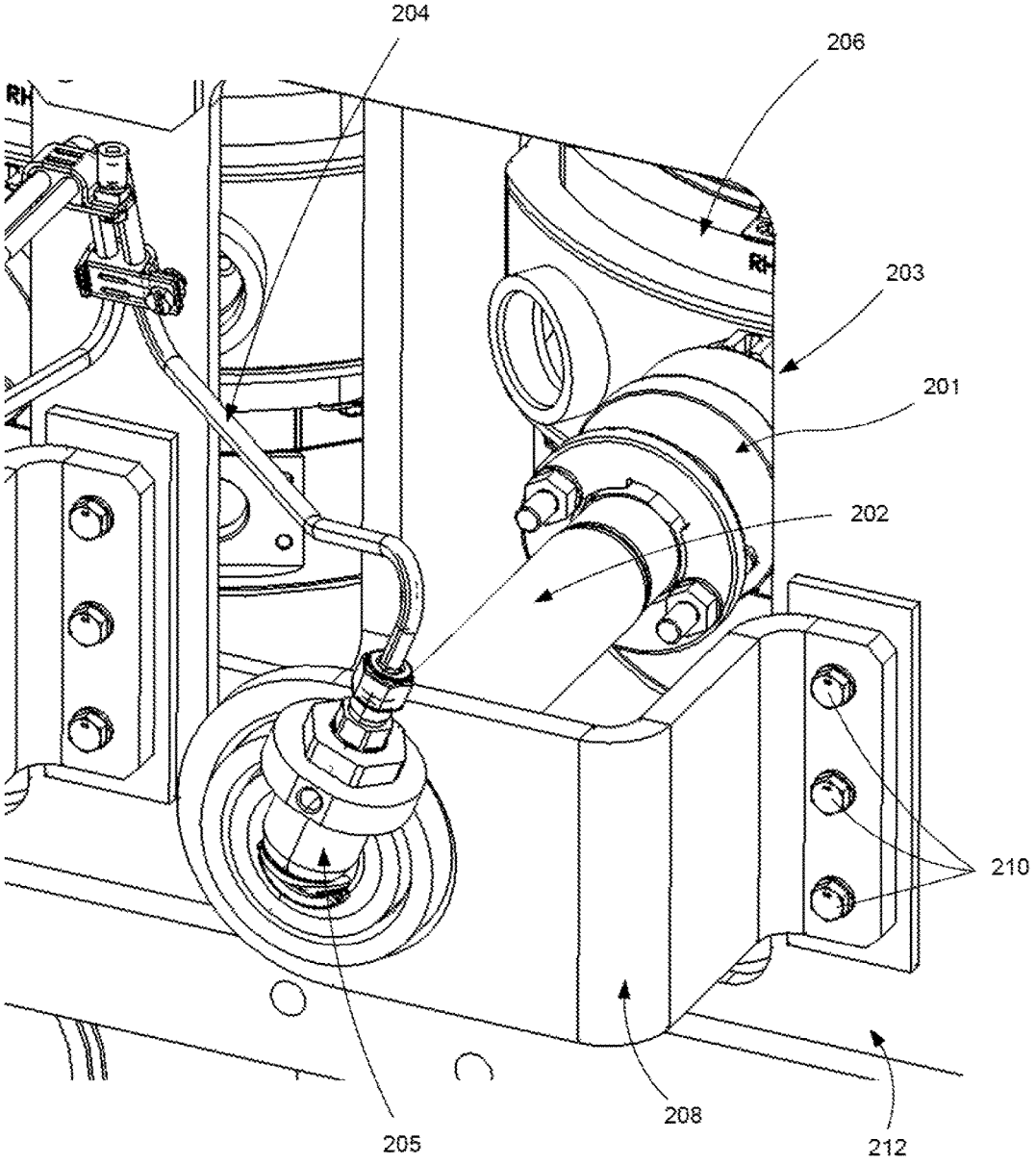
FIG. 3 is an enlarged isometric view of a fuel injector mounting system according to a representative embodiment.

As shown in FIG. 2, the fuel system 200 includes a plurality of fuel injectors 202 supplied by fuel lines 204. In the depicted embodiment, the engine includes twelve cylinders, each of which is supplied by two fuel injectors 202 located on opposite sides of the engine 100. With further reference to FIG. 3, each fuel injector 202 is associated with a fuel injector mounting system 201. The fuel injector mounting system 201 mounts the fuel injector 202 to a corresponding cylinder liner 206. A proximal end portion 203 (e.g., nozzle end) of the fuel injector 202 is held in position relative to the cylinder liner 206. An injector support bracket 208 is mounted to the engine block 212 and supports a distal end portion 205 of the injector 202. The injector support bracket 208 is mounted to the engine block 212 with a plurality of fasteners such as cap screws 210.

Figure 4:
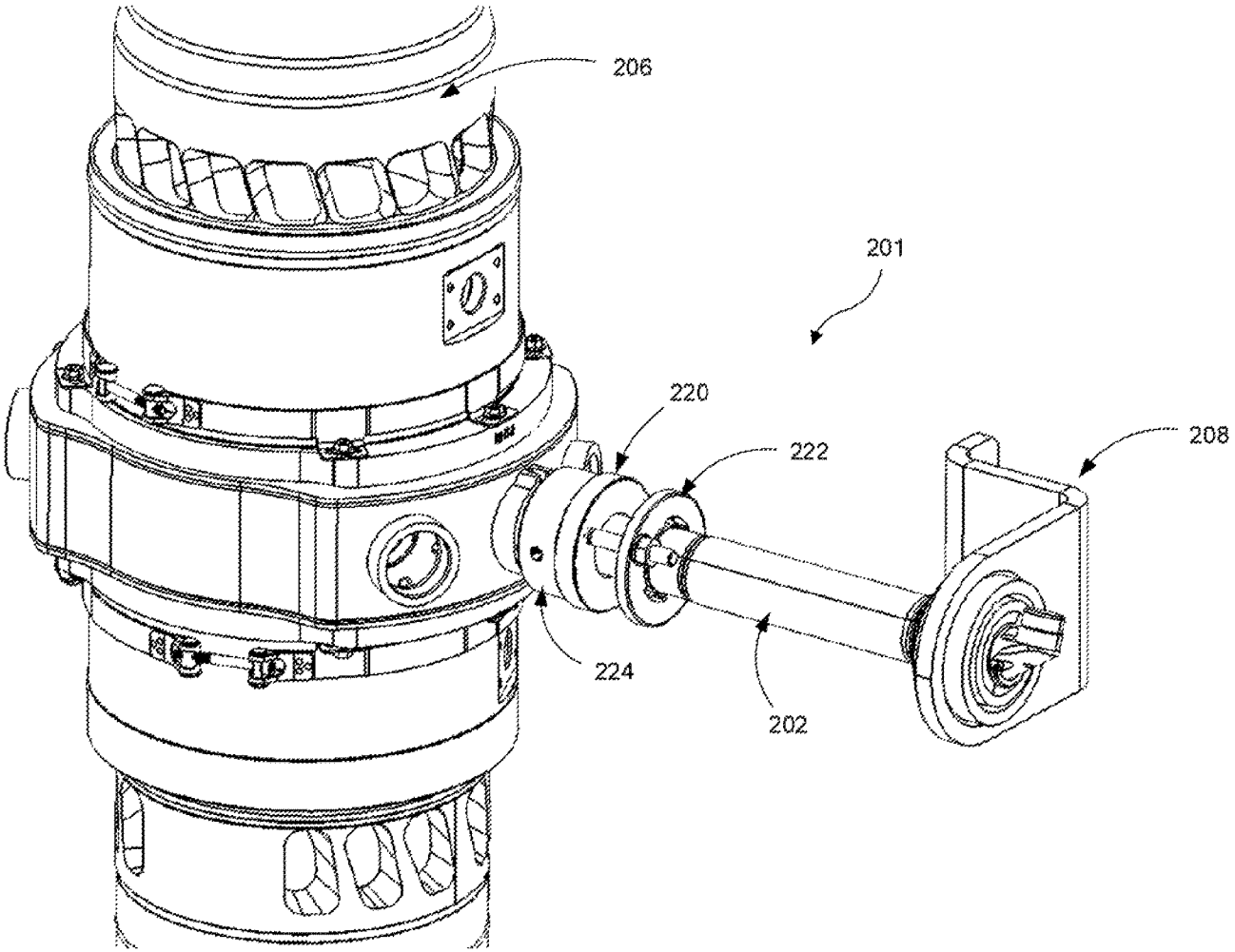
FIG. 4 is an isometric view of the fuel injector mounting system with surrounding components removed for clarity.

As shown in FIG. 4, the fuel injector mounting system 201 includes the injector 202, the support bracket 208, an injector adapter 220, a retaining collar 222, and an annular fitting 224 for collecting injector leakage. Although, a diesel injector is depicted in the figures, the disclosed technology can be applied to other types of injectors. For example, liquid or gaseous fuel injectors, such as gasoline or natural gas injectors, can be mounted with the disclosed fuel injector mounting system.

Figure 5:
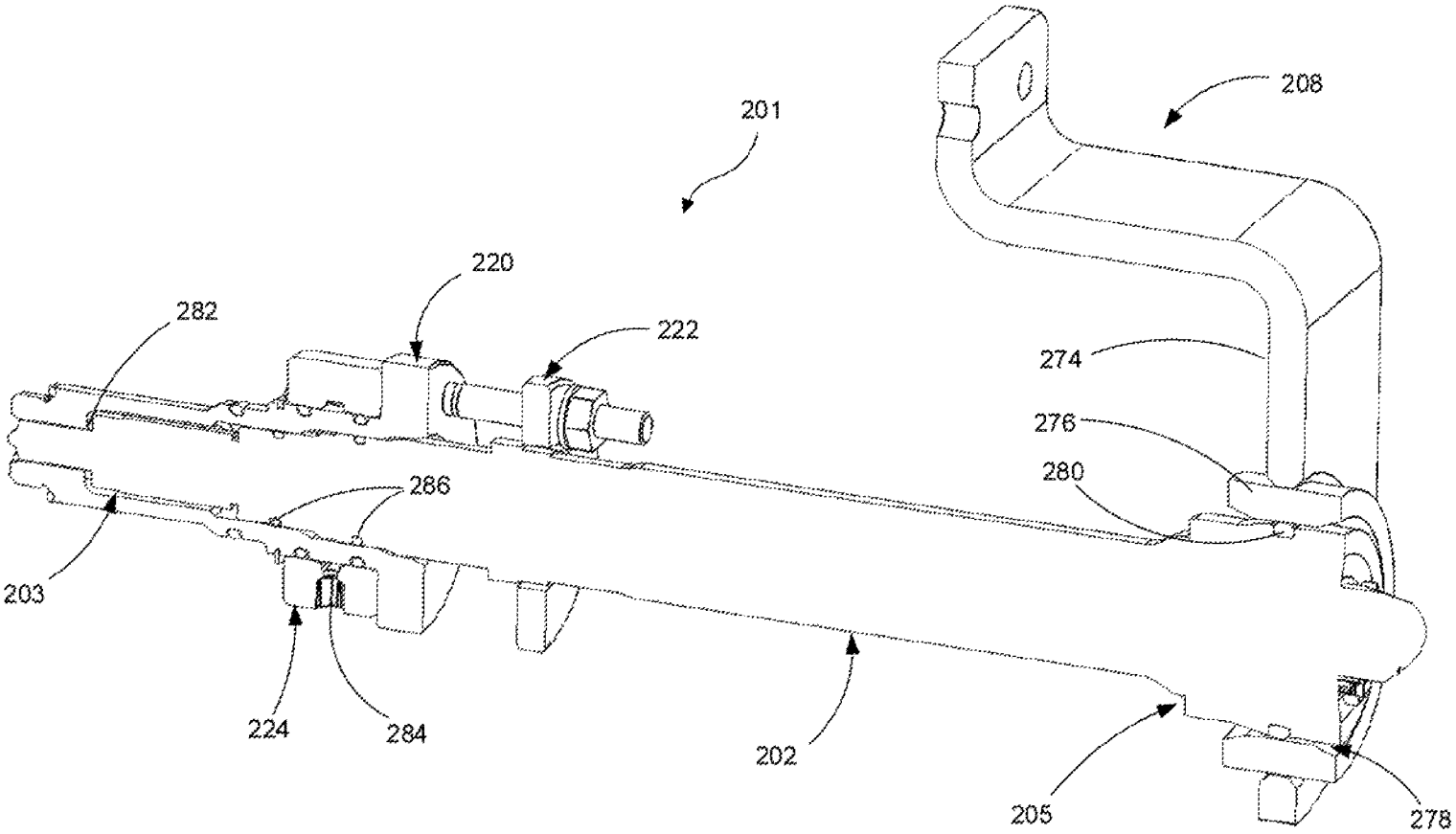
FIG. 5 is an isometric cross-section of the fuel injector mounting system.

With reference to FIG. 5, the injector support bracket 208 includes a bracket arm 274 that supports a cylindrical injector mounting boss or ring 276. In the depicted embodiment, the bracket arm 274 is in the form of an S-shaped arm. In other embodiments, the bracket arm can have different configurations to accommodate different engines and/or injectors, for example. In some embodiments, the mounting ring 276 can be welded to the bracket arm 274, as illustrated. The mounting ring 276 includes an opening 278 sized and configured to receive the distal end portion 205 of injector 202. In some embodiments, the distal end portion 205 includes an O-ring 280 which is received within the opening 278 of the mounting ring 276. The O-ring 280 helps to dampen vibrations generated by operation of the engine 100 that might otherwise transfer to the injector 202.

Also shown in FIG. 5, the injector 202 is received within the injector adapter 220. The proximal end portion 203 is sealed against the inside of the injector adapter 220 with sealing washer 282. The annular fitting 224, sometimes referred to as a banjo fitting, is positioned on an outer diameter of the injector adapter 220 and is configured to collect nozzle leakage which exits the injector 202 between O-rings 286. Any collected fuel leakage is conveyed away from the injector via outlet port 284.

Figure 6:
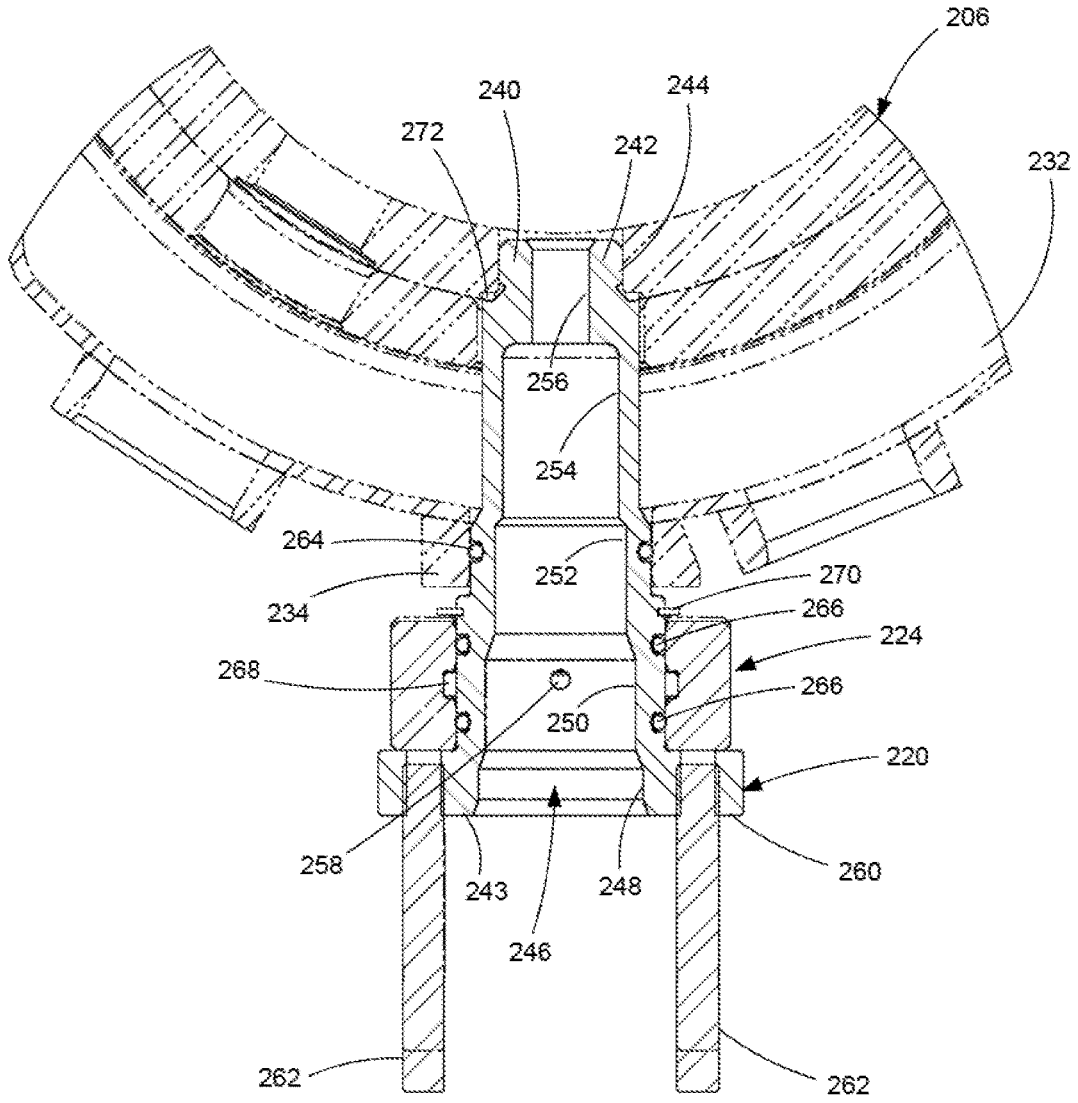
FIG. 6 is a cross sectional view of the fuel injector adapter.

With further reference to FIG. 6, the injector adapter 220 includes one or more transverse passageways 258 that extend through a sidewall of the injector adapter 220 and intersects the injector port 246. As mentioned above, injector 202 may have some fuel leakage, which is typical of diesel injectors, for example. Any fuel leaking from injector 202 is collected in the injector port 246 and exits through transverse passageway 258. The annular fitting 224 is positioned on the injector adapter 220 for fluid communication with the transverse passageway 258. The annular fitting 224 includes a circumferential groove 268 aligned with the passageway 258. As mentioned above, the annular fitting 224 includes an outlet port 284 (shown in FIG. 5) for collecting the nozzle leakage. The annular fitting 224 is sealed against the outside diameter of the injector adapter 220 on both sides of the groove 268 with a pair of O-rings 266. In some embodiments, the annular fitting 224 abuts a flange 260 and is retained on the injector adapter 220 by a snap ring 270.

The injector adapter 220 includes a longitudinally extending adapter body 240. The adapter body 240 includes a first end portion 242 having threads 244 formed thereon for engagement with the cylinder liner 206. The adapter body 240 seals against the cylinder liner 206 with a sealing washer 272. The injector port 246 is formed into a second end portion 243 of the adapter body 240 opposite the first end portion 242. The injector port 246 includes a plurality of concentric bores 248, 250, 252, 254, and 256 that are configured to receive the proximal end portion 203 of the fuel injector 202 (see FIG. 5). Although the depicted embodiment includes five concentric bores of various lengths and diameters, other embodiments can comprise different injector port configurations to accommodate different injectors.

The adapter body 240 extends through a coolant collar 232 and engages the cylinder liner 206. Coolant travels in the space between the coolant collar 232 and the cylinder liner 206. Accordingly, the adapter body 240 includes an O-ring 264 to seal against the coolant collar boss 234. It should be appreciated that O-ring 264, as well as other O-ring seals mentioned herein, each have a corresponding O-ring groove appropriately sized and configured for the O-ring.

Figure 7:
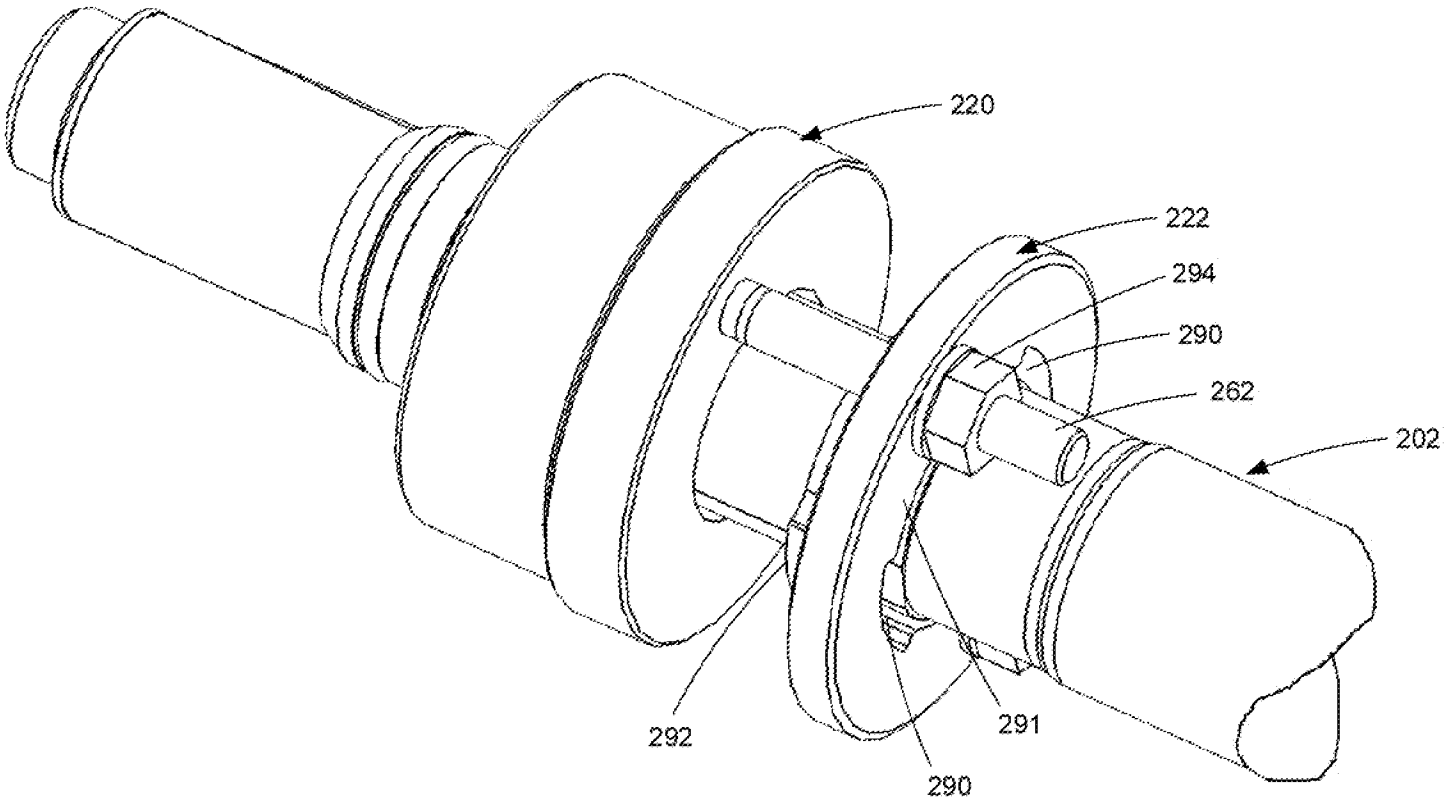
FIG. 7 is a partial isometric view of the injector adapter and retaining collar.

Injector body 240 includes a flange 260 that extends transversely from the second end portion 243 of the adapter body 240. A pair of threaded studs 262 are connected to the flange 260 for mounting the retaining collar 222 (shown in FIG. 5). With further reference to FIG. 7, retaining collar 222 is attached to mounting studs 262 with fasteners such as nuts 294. Retaining collar 222 includes a pair of notches 290 and corresponding internal tabs 291. The notches 290 are configured to receive external tabs or ears 292 formed on the injector 202. Accordingly, the injector tabs 292 may be inserted through notches 290 and rotated to engage the internal tabs 291, thereby allowing collar 222 to retain the injector 202 in the adapter 220. As fasteners 294 are tightened the injector 202 is urged into the injector port 246 thereby compressing sealing washer 282 (shown in FIG. 5).

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments. Accordingly, the embodiments are not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. An injector mounting system for mounting an injector to an engine, the system comprising:

an injector adapter, including:

a longitudinally extending adapter body, including:

a first end portion configured for connection to an engine;

an injector port formed in the adapter body opposite the first end portion to receive a proximal end portion of an injector;

a transverse passageway extending through a sidewall of the adapter body and intersecting the injector port; and a flange extending from the adapter body; and a collar connected to the flange and configured to engage a portion of the injector; and a fitting disposed around at least a portion of the sidewall for fluid communication with the transverse passageway.

2. The system of claim 1, wherein the fitting is positioned on the adapter body to abut the flange.

3. The system of claim 2, wherein the fitting includes a groove aligned with the transverse passage.

4. The system of claim 1, wherein the collar includes two or more internal tabs positioned to engage external tabs on the injector.

5. The system of claim 4, further comprising two or more fasteners connecting the collar and flange, whereby tightening the fasteners urges the injector into the injector port.

6. The system of claim 4, further comprising an injector support bracket configured to attach a distal end portion of the injector to the engine.

7. The system of claim 6, wherein the support bracket includes a cylindrical boss sized to receive the distal end portion of the injector.

8. The system of claim 7, further comprising a fuel injector having a proximal end portion and a distal end portion, wherein the proximal end portion is positioned in the injector bore and the distal end portion is positioned in the cylindrical boss.

9. An injector mounting system for mounting an injector to an engine, the system comprising:

an injector having a proximal end portion and a distal end portion; and an injector adapter, including:

a longitudinally extending adapter body, including:

a first end portion configured for connection to an engine;

an injector port formed in the adapter body opposite the first end portion to receive the proximal end portion of the fuel injector;

a transverse passageway extending through a sidewall of the adapter body and intersecting the injector port; and a flange extending from the adapter body; and a collar connected to the flange and configured to engage a portion of the injector.

10. The system of claim 9, wherein the collar includes two or more internal tabs positioned to engage external tabs on the injector.

11. The system of claim 10, wherein the collar includes one or more notches corresponding to the two or more internal tabs, selected ones of which are configured to receive an associated external tab therethrough, whereby the injector can be rotated to place the external tabs into alignment with the internal tabs for engagement therewith.

12. The system of claim 11, further comprising two or more fasteners connecting the collar and flange, whereby tightening the fasteners urges the injector into the injector port.

13. The system of claim 9, further comprising a fitting connected to the injector adapter for fluid communication with the transverse passageway.

14. The system of claim 9, wherein the injector port includes a plurality of concentric bores.

15. The system of claim 9, further comprising an injector support bracket configured to attach the distal end portion of the fuel injector to the engine.

16. The system of claim 9, wherein the first end portion is threaded for engagement with a cylinder liner of the engine.

17. An injector adapter for mounting an injector to an engine, comprising:

a longitudinally extending adapter body having a first end portion configured for connection to an engine;

an injector port formed in the adapter body opposite the first end portion to receive a proximal end portion of an injector;

a flange extending from the adapter body; and a collar connected to the flange and configured to engage a portion of the injector, wherein the collar includes two or more internal tabs positioned to engage corresponding external tabs extending from the injector.

18. The adapter of claim 17, wherein the collar includes one or more notches corresponding to the two or more internal tabs, selected ones of which are configured to receive an associated external tab therethrough, whereby the injector can be rotated to place the external tabs into alignment with the internal tabs for engagement therewith.

19. The adapter of claim 18, further comprising two or more fasteners connecting the collar to the flange, whereby tightening the fasteners urges the injector into the injector port.

20. The adapter of claim 17, further comprising a transverse passageway extending through a sidewall of the adapter body and intersecting the injector port.

* * * * *